United States Patent [19]

Kleefeldt et al.

[11] Patent Number: 5,056,343

[45] Date of Patent: Oct. 15, 1991

[54] ACTUATOR FOR POWER DOOR LATCH

[75] Inventors: Frank Kleefeldt; Rolf Schüler, both of Heiligenhaus, Fed. Rep. of Germany

[73] Assignee: Kiekert GmbH & Co. Kommanditgesellschaft, Heiligenhaus, Fed. Rep. of Germany

[21] Appl. No.: 599,795

[22] Filed: Oct. 18, 1990

Related U.S. Application Data

[63] Continuation-in-part of Ser. No. 389,832, Aug. 4, 1989, abandoned.

[30] Foreign Application Priority Data

Aug. 13, 1988 [DE] Fed. Rep. of Germany ..... 3827586

[51] Int. Cl.[5] ..... E05B 53/00; E05B 65/36

[52] U.S. Cl. ..... 70/264; 70/237; 70/280; 292/DIG. 3; 292/DIG. 23; 292/DIG. 25

[58] Field of Search ..... 70/262, 263, 264, 237, 70/280, 283, 256–257; 292/201, 144, DIG. 3, DIG. 14, DIG. 23, DIG. 25, 337, 336.3

[56] References Cited

U.S. PATENT DOCUMENTS

| | | | |
|---|---|---|---|
| 4,135,377 | 1/1979 | Kleefeldt | 70/264 |
| 4,342,209 | 8/1982 | Kleefeldt | 70/264 |
| 4,440,006 | 4/1984 | Kleefeldt | 70/264 |
| 4,669,283 | 6/1987 | Ingenhoren | 70/264 |
| 4,932,690 | 6/1990 | Kleefeldt | 292/337 |

*Primary Examiner*—Robert L. Wolfe

*Attorney, Agent, or Firm*—Herbert Dubno; Andrew Wilford

[57] ABSTRACT

A motor-vehicle latch has an actuating lever displaceable between a position in which a respective door of the vehicle is locked and a position in which the respective door is unlocked. A locking knob connected to the lever is accessible from inside the vehicle to displace the lever between its positions. The actuator has a housing mounted directly on the door latch and formed with at least one longitudinally directed abutment face, a motor in the housing, a nut longitudinally displaceable in the housing by the motor between unlocked, locked, and antitheft positions, and a slide in the housing movable by the nut between locked and unlocked positions and formed with a recess receiving a portion projecting from the lever. At least one flexible arm extends longitudinally from the slide and has a head formed with a face directed longitudinally opposite the abutment face of the housing. These faces longitudinally confront but are out of longitudinal line with each other in the locked positions of the slide and nut. An actuating formation on the nut is engageable with the arm for laterally elastically deflecting the arm on displacement of the nut from the respective locked to the anti-theft position. Thus the faces are longitudinally aligned and prevent displacement of the slide into the unlocked position with the nut in the anti-theft position.

8 Claims, 4 Drawing Sheets

ACTUATOR FOR POWER DOOR LATCH

Cross Reference to Related Application

This application is a continuation-in-part of copending patent application 07/389,832 filed Aug. 4, 1989 and now abandoned.

FIELD OF THE INVENTION

The present invention relates a motor-vehicle door latch. More particularly this invention concerns an actuator assembly for such a latch used in a motor-vehicle central-lock system.

BACKGROUND OF THE INVENTION

A standard central motor-vehicle lock system has a plurality of door latches on the individual doors, hatches, trunk lids, and the like that are each operable by a respective power actuator and also by a manual mechanism. The power actuator can include a hydraulic, pneumatic, or electric motor, and the manual mechanism is almost always a lever linkage.

In a standard system such as described in my U.S. Pat. No. 4,342,209 each door latch has a locking lever displaceable between a pair of end positions corresponding to locked and unlocked conditions of the respective door. This lever is connected on the one side via a rod to the inside unlocking button in the case of a door and on the other side via another rod to the power actuator which is mounted in the door at some remove from the latch. Thus either the knob or the actuator can be operated to lock or unlock the door.

It has become common to provide a standard central locking system with a so-called antitheft feature. When set in the antitheft mode it is impossible to unlock the vehicle doors even by manual actuation of the inside knobs. Thus a person who breaks a window or otherwise gains forcible entry to the vehicle cannot open its doors.

Such a system is typically incorporated into the abovedescribed power actuator by either driving the element that acts via the rod on the unlocking lever with such a large mechanical advantage that forcible reverse-driving of this motor is impossible, or by providing a system which positively freezes this actuating element. Either way action on the inside knob will be countered by the actuator via the rod connecting it to the latch locking lever.

A weakness of such a system is that an extreme force exerted on the inside knob, for instance by prying on it, can bend or break the rod connecting the locking lever to the actuator. This problem is particularly great when the knob must be pulled away from the latch to unlock the door, as the amount of force such a rod can withstand in tension is considerably greater than the forces that the rest of the elements can resist. The only way to make the system secure against such attack is to dimension all the parts of the entire connection between the actuator and the locking lever so they are very strong. This augments the weight and cost of these elements considerably.

It is known from commonly owned patent application 343,583 filed Apr. 25, 1989 for a standard power-type motor-vehicle latch assembly to have an actuator housing that is mounted directly on the door latch and to form the locking lever of the latch integrally with an actuating arm having an end projecting from the latch into the actuator housing and forming part of the linkage. The element is formed with a seat receiving the arm end and also forming part of the linkage.

This latter system represents a substantial improvement, yet still could be stronger.

OBJECTS OF THE INVENTION

It is therefore an object of the present invention to provide an improved actuator assembly for a motor-vehicle door latch.

Another object is the provision of such an improved actuator assembly for a motor-vehicle door latch which overcomes the above-given disadvantages, that is which is of simple but very robust construction.

SUMMARY OF THE INVENTION

The instant invention is a power actuator used in combination with a motor-vehicle latch having an actuating lever displaceable between a position in which a respective door of the vehicle is locked and a position in which the respective door is unlocked and which is formed with a portion projecting from the latch. A locking knob connected to the lever is accessible from inside the vehicle to displace the lever between its positions. The actuator according to this invention has a housing mounted directly on the door latch and formed with at least one longitudinally directed abutment face, a motor in the housing, a nut longitudinally displaceable in the housing by the motor between unlocked, locked, and antitheft positions, and a slide in the housing movable by the nut between locked and unlocked positions and formed with a recess receiving the projecting portion of the lever. At least one flexible arm extends longitudinally from the slide and has a head formed with a face directed longitudinally opposite the abutment face of the housing. These faces longitudinally confront but are out of longitudinal line with each other in the locked positions of the slide and nut. An actuating formation on the nut is engageable with the arm for laterally elastically deflecting the arm on displacement of the nut from the respective locked to the antitheft position. Thus the faces are longitudinally aligned and prevent displacement of the slide into the unlocked position with the nut in the antitheft position.

Thus with this system a long coupling rod is not needed, yet the locking lever is solidly held in place when the system is in the antitheft position. The flatly engaging abutment faces of the projection head and housing can resist forces much greater than the standard blocking thread or one-way transmission used to displace the slide. This invention uses a locking system similar to that described in commonly owned patent application 07/343,584 filed Apr. 25, 1989 by P. Bartel to allow the system of this invention to very solidly lock the lever in place. The slide can be made of a durable synthetic resin and the housing of the actuator of steel for a long service life.

According to another feature of this invention the housing is held on the latch by at least two spaced pins projecting from the latch in a direction transverse to the displacement direction of the slide and fitting snugly into holes formed in the actuator housing. In addition releasable holding members engageable between the latch and the actuator housing hold same releasably together.

The actuator housing of this invention is formed with a slot through which the lever end projects and at which the slide recess is exposed, the pins flanking the slot. In addition the arm and head together are of T-shape, the head also being formed with a camming face engageable with the actuating formation of the nuts. The actuating formation has an inclined camming end face engageable longitudinally with the camming face of the head.

In accordance with a further feature of this invention the motor is a reversible electric motor and the actuator includes a worm linkage connecting the motor to the slide. Furthermore the lever has a second such arm separate from the firstmentioned arm and the assembly has a rod connecting the second arm to the knob. For strongest possible holding power according to the invention the slide has two such projections each with a respective such head and the nut has two such actuating formations.

DESCRIPTION OF THE DRAWING

The above and other objects, features, and advantages will become more readily apparent from the following, reference being made to the accompanying drawing in which.

DETAILED DESCRIPTION

Figure 1:
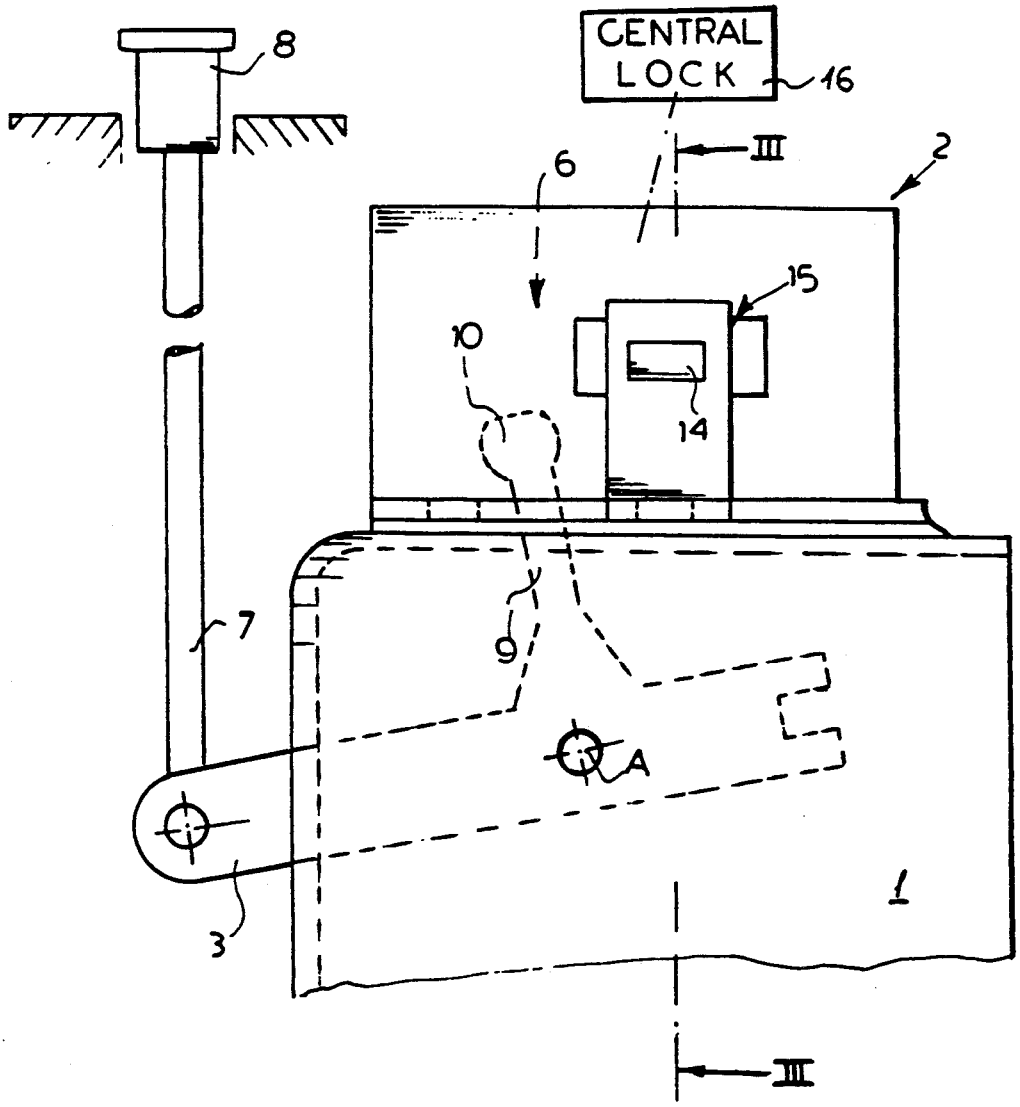
FIG. 1 is a partly schematic side view of the latch assembly according to this invention.

As seen in FIG. 1 a motor-vehicle door latch 1 can be operated by an actuator 2 that is powered along with the other door and trunk latches from a remote central lock system 16 of the type generally described in the above-cited patent and patent applications. The latch 1 has, in addition to the locking fork 3 and standard inside-door and outside-door actuating mechanisms that are not relevant to the instant invention, a locking lever 3 which in the illustrated embodiment is pivoted clockwise about its axis A to unlock the door and counterclockwise to lock it. A standard inside button 8 is connected via a rod 7 to this lever 3 to operate it manually from inside the vehicle.

Figure 2:
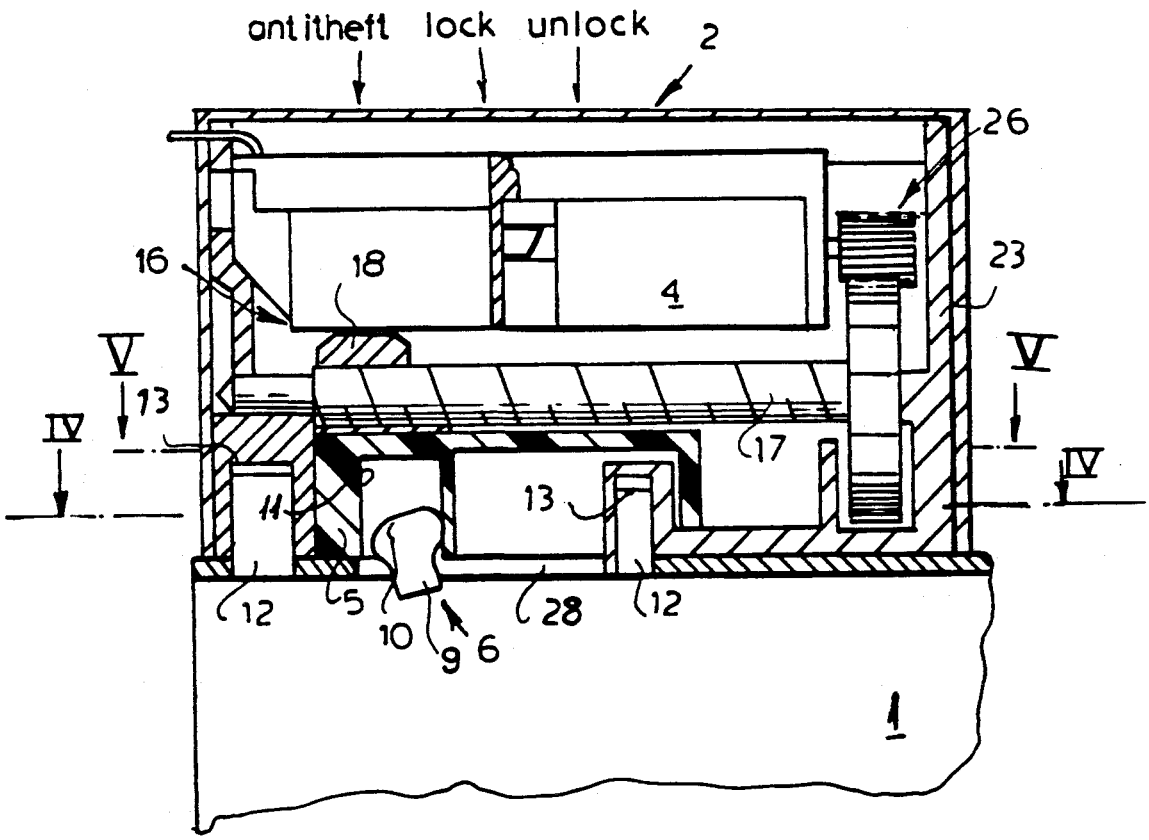
FIG. 2 is a large-scale sectional view of the upper portion of the structure of FIG. 1.
Figure 3:
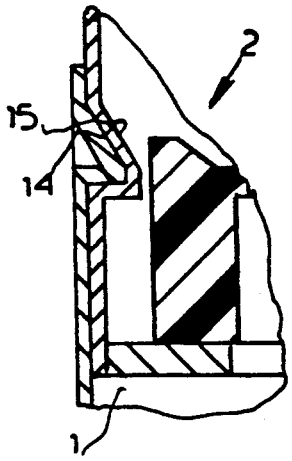
FIG. 3 is a section taken along line III—III of FIG. 1 of a detail of the latch assembly.

As best seen in FIGS. 2 and 3 the power actuator 2 has a substantially closed housing 23 made of steel and provided internally with a reversible electric motor 4 connected through a gearing 26 to a slide 5 so that rotation of the motor output shaft in one sense moves the slide 5 in one direction and vice versa. The locking lever 3 has a supplementary actuating element 6 constituted by an arm 9 projecting radially from the axis A and having a head 10 that projects through an aperture in the side of the latch 1 and through a slot 28 into the housing 23. The slide 5 can reciprocate above this slot 28 and is formed with an outwardly open recess or seat 11 in which the head 10 is received with slight play. Thus, when the slide 5 moves, the lever 3 will be acted on directly, and with considerable force. Similarly the high stepdown between the motor 4 and the slide 5 ensures that a force brought to bear on this slide 5 will not be able to reverse drive the motor 4.

The housing 23 is held in position on the housing of the latch 1 by two pins 12 that are fixed on this latch 1 and that project from it, fitting snugly into complementary holes 13 formed at each end of the slot 28. One of the pins 12 is larger than the other to make reverse mounting of the actuator 2 impossible. In addition as seen in FIG. 3 each side of the housing 23 is formed with a sawtooth pocket 15 into which a complementary tooth 14 of an elastically deformable finger 20 fixed on the latch 1 can fit. Thus mounting of the actuator 2 on the latch 1 is as easy as pushing it down over the pins 12 until the barb teeth 14 snap into their pockets 15. Disassembly requires that these teeth 14 be pulled out of their seats while the actuator 2 is lifted. Both operations require no tools but once the two parts are joined normal operation will not force them apart since the pins 12 are capable of withstanding considerable shear.

Figure 4:
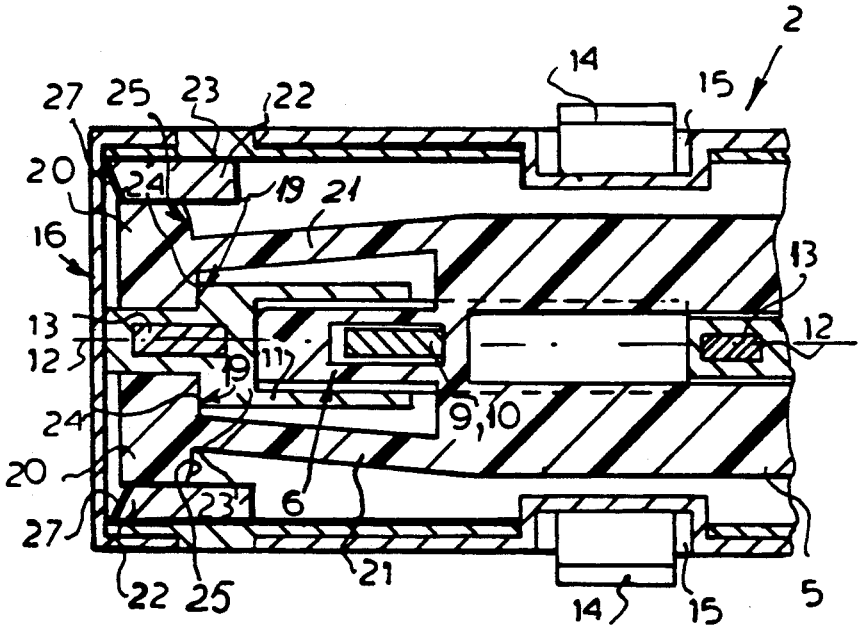
FIGS. 4 and 5 are sections taken along respective lines IV—IV and V—V of FIG. 2.

According to this invention and as best seen in FIGS. 2 and 4 the slide 5 is provided with a nut 18 riding on a threaded spindle 17 driven through the gearing 26 by the motor 4. In addition the slide 5, which is made of a durable but flexible synthetic resin, is formed with a pair of relatively thin extensions or arms 21 terminating at square heads 20 each having an inner squared-off abutment face 24 and an outer rounded pusher face 25. The nut 18 in turn is formed with a pair of abutments 22 having angled outer ends 27 that can engage the rounded pusher faces 25 of the heads 20 The housing 23 itself is integrally formed with outwardly directed square detent faces 19 that can flatly engage the abutment faces 24 of the heads 20.

Figure 5:
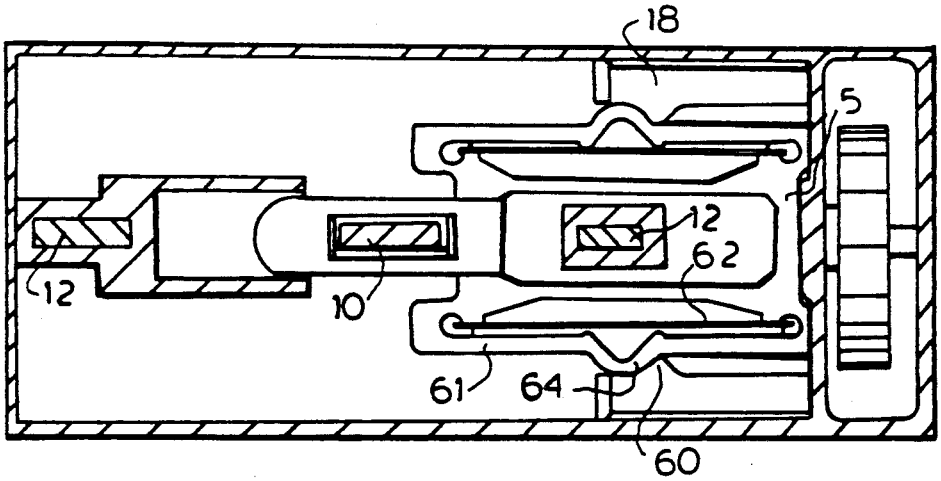

FIG. 5 further shows how the nut 18 is formed with inwardly directed bumps 60 and the slide 5 has webs 61 formed with outwardly directed bumps 64 braced by leaf springs 62. Thus the bumps 60 and 64 with couple the parts 5 and 18 together until rightward movement of the slide 5 is blocked by it coming to the end of the housing 23, whereupon the bumps 64 will be reflected elastically inward and the slide 18 will continue until it comes to the end of its travel.

The abutments 22 of the nut 18 form with the heads 20 a lost motion coupling in that these abutments 22 will engage as seen in FIG. 4 to the right of and behind the heads 20 during movement of the nut 18 toward the left. Only when as seen in FIG. 4 the heads 20 have been cammed by the angled outer ends 27 inward can the abutments 22 and the nut 18 continue to move to the right. Thus as the nut 18 and slide 5 move toward the left as seen in FIGS. 2 and 4 the lever 3 will first be rocked from an unlock to a lock position corresponding respectively to an unlocked and locked condition of the latch 1. Further rotation of the spindle 17 in the same sense will continue to move the nut 18 to the left into an antitheft position while leaving the slide 5 stationary. This further movement of the nut 18 into the antitheft position illustrated in FIGS. 2 and 4 will bring the angled end faces 27 of the abutments 22 into engagement with the rounded faces 25, camming the heads 20 inward. Once cammed inward into the position shown in FIG. 4 the faces 19 and 24 engage each other flatly and the slide 5 can resist enormous force toward the right, into the unlock position.

To unlock the door the nut 18 first moves to the right sufficiently to let the extensions 21 act under their own resilience and let the heads 20 pop out from behind the faces 19, whereupon further movement of the nut 18 will also move the slide 5 and allow it to shift into the unlocking position. Thus the lost motion of the coupling formed between the nut 18 and slide 5 takes place as the abutments 22 slide past the heads 20 in both directions.

We claim:

1. In combination with a motor-vehicle latch having an actuating lever displaceable between a position in which a respective door of the vehicle is locked and a position in which the respective door is unlocked, the lever being formed with a portion projecting from the latch; and a locking knob connected to the lever and accessible from inside the vehicle to displace the lever between its positions; a power actuator comprising:

a housing mounted directly on the door latch and formed with at least one longitudinally directed abutment face;

a motor in the housing;

a nut longitudinally displaceable in the housing by the motor between unlocked, locked, and antitheft positions;

a slide in the housing movable by the nut between locked and unlocked positions and formed with a recess receiving the projection portion of the lever;

at least one flexible arm extending longitudinally from the slide and having a head formed with a face directed longitudinally opposite the abutment face of the housing, the faces longitudinally confronting but being out of longitudinal line with each other in the locked positions of the slide and nut; and a respective actuating formation on the nut engageable with the arm for laterally elastically deflecting the arm on displacement of the nut from the respective locked to the antitheft position, the faces being longitudinally aligned and preventing displacement of the slide into the unlocked position with the nut in the antitheft position.

2. The actuator/latch assembly defined in claim 1, further comprising:

at least two spaced pins projecting from the latch in a direction transverse to the displacement direction of the slide, the actuator housing being formed with holes snugly receiving the pins; and means including releasable holding members engageable between the latch and the actuator housing for holding same releasably together.

3. The actuator/latch assembly defined in claim 2 wherein the actuator housing is formed with a slot through which the lever end projects and at which the slide recess is exposed, the pins flanking the slot.

4. The actuator/latch assembly defined in claim 1 wherein the arm and head together are of T-shape, the head also being formed with a camming face engageable with the actuating formation of the nuts.

5. The actuator/latch assembly defined in claim 1 wherein the actuating formation has an inclined camming end face engageable longitudinally with the camming face of the head.

6. The actuator/latch assembly defined in claim 1 wherein the motor is a reversible electric motor and the actuator includes a high-stepdown gearing connecting the motor to the slide.

7. The actuator/latch assembly defined in claim 1 wherein the lever has a second such arm separate from the firstmentioned arm, the assembly further comprising a rod connecting the second arm to the knob.

8. The actuator/latch assembly defined in claim 1 wherein the slide has two such projections each with a respective such head and the nut has two such actuating formations.

* * * * *